United States Patent [19]
Hata et al.
[11] 4,290,404
[45] Sep. 22, 1981

[54] FUEL SUPPLY CONTROL SYSTEM

[75] Inventors: Yoshitaka Hata, Fujisawa; Kenji Okamura, Yokohama, both of Japan

[73] Assignee: Nissan Motor Company, Limited, Yokohama City, Japan

[21] Appl. No.: 93,672

[22] Filed: Nov. 13, 1979

[30] Foreign Application Priority Data

Nov. 30, 1978 [JP] Japan ..... 53-147235

[51] Int. Cl.[3] ..... F02M 25/06

[52] U.S. Cl. ..... 123/571; 123/440; 123/568

[58] Field of Search ..... 123/571, 569, 568, 440

[56] References Cited

U.S. PATENT DOCUMENTS 4,161,929 7/1979 Nohira et al. ..... 123/571
4,164,032 8/1979 Nohira et al. ..... 123/571
4,195,531 4/1980 Okamura ..... 123/571

FOREIGN PATENT DOCUMENTS 2553699 8/1976 Fed. Rep. of Germany .
2655461 6/1977 Fed. Rep. of Germany .
2700266 7/1977 Fed. Rep. of Germany .

*Primary Examiner*—Wendell E. Burns
*Attorney, Agent, or Firm*—Schwartz, Jeffery, Schwaab, Mack, Blumenthal & Koch

[57] ABSTRACT

A fuel supply control system for use in an internal combustion engine equipped with an exhaust gas recirculation system is disclosed which determines an amount of fuel supplied to the engine in accordance with intake air flow derived from engine suction vacuum and engine speed and corrected in accordance with exhaust gas recirculation flow. The engine suction vacuum and exhaust gas recirculation flow measurements are made in accordance with pressure measured at suitable points by semiconductor pressure sensors.

6 Claims, 2 Drawing Figures

FUEL SUPPLY CONTROL SYSTEM

BACKGROUND OF THE INVENTION

1. Field of the Invention

This invention relates to an electronically controlled fuel injection system for use in an internal combustion engine and, more particularly, to a simple and inexpensive fuel supply control system for determining an amount of fuel supplied to the engine in accordance with intake air flow.

2. Description of the Prior Art

It is common practice to use an electronic control system to control the amount of fuel supplied to an internal combustion engine in accordance with engine suction vacuum appearing in the intake passage downstream of the throttle valve. However, such practice cannot be applied to the case where an exhaust gas recirculation system is incorporated in such an engine in order to improve its exhaust emission characteristics, since changes of exhaust gas recirculation flow cause the engine suction vacuum to increase or decrease so as to produce a great divergence between the requisite and actual quantities of fuel supplied to the engine, resulting in poor fuel economy, exhaust emission characteristics and drivability. For this reason, the amount of fuel supplied to the engine has been controlled in accordance with intake air flow detected by an expensive air flow meter provided in the intake passage.

In recent years, accurate and inexpensive semiconductor pressure sensors have been in extensive use. Accordingly, it is advantageous in cost and accuracy to control the amount of fuel supplied to the engine in accordance with intake air flow derived from engine speed and engine suction vacuum and corrected in accordance with exhaust gas recirculation flow, using semiconductor pressure sensors to measure the engine suction vacuum and exhaust gas recirculation flow.

SUMMARY OF THE INVENTION

It is therefore one object of the present invention to provide an inexpensive fuel supply control system which can control the amount of fuel supplied to an engine according to intake air flow with greater accuracy.

Another object of the present invention is to provide an improved fuel supply control system which is suitable particularly for use in an internal combustion engine equipped with an exhaust gas recirculation system.

Still another object of the present invention is to provide an improved fuel supply control system which can control the rate of exhaust gas recirculation in accordance with engine operating conditions.

According to the present invention, these and other objects are accomplished by a fuel supply control system for use in an internal combustion engine including an intake passage provided therein with a throttle valve, an exhaust passage, and an exhaust gas recirculation passage connecting the exhaust passage to the port of the intake passage provided downstream of the throttle valve and containing an exhaust gas recirculation valve, the system comprising a suction vacuum sensor for detecting the suction vacuum appearing in the intake passage downstream of the throttle valve, an orifice provided in the exhaust gas recirculation passage between the port and the exhaust gas recirculation valve, a pressure difference sensor for detecting the pressure difference between the opposite sides of the orifice, a speed sensor for detecting the speed of rotation of the engine, and means for determining an amount of fuel supplied to the engine in accordance with the intake air flow derived from the suction vacuum detected by the suction vacuum sensor and the engine speed detected by the speed sensor and also corrected in accordance with the exhaust gas recirculation flow derived by the pressure difference detected by the pressure difference sensor.

Other objects, features, and advantages of the present invention will become apparent to one skilled in the art thereof from the following description.

BRIEF DESCRIPTION OF THE DRAWINGS

The following explanation of the preferred embodiment of the present invention will help in the understanding thereof, when taken in conjunction with the accompanying drawings, which, however, should not be taken as limiting the present invention in any way, but which are given for purposes of illustration only. In the drawings, like parts are denoted by like reference numerals, and.

DESCRIPTION OF THE PREFERRED EMBODIMENT

Figure 1:
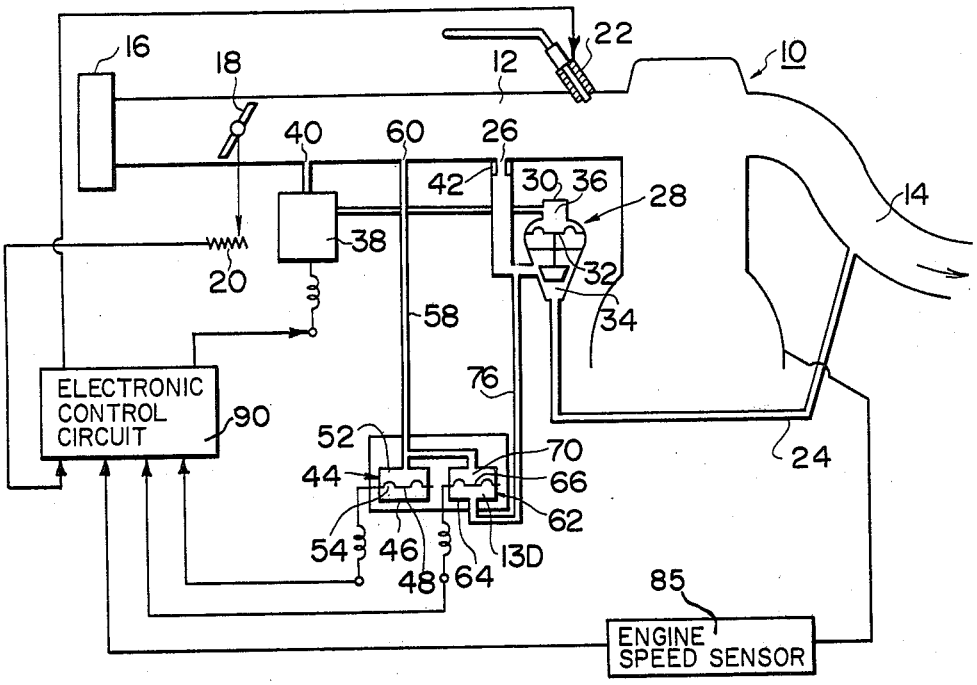
FIG. 1 is a schematic view showing one embodiment of a fuel supply control system constructed in accordance with the present invention.

Referring now to FIG. 1, there is schematically illustrated an internal combustion engine 10 which includes intake and exhaust passages 12 and 14. The intake passage 12 is connected through an air cleaner 16 to the atmospheric air and contains a throttle valve 18 associated with a throttle opening sensor 20. A fuel injection valve 22 is provided in the intake passage 12 near its downstream end. The engine 10 also includes an exhaust gas recirculation (EGR) passage 24 connecting the exhaust passage 14 to the first port 26 of the intake passage 12 provided downstream of the throttle valve 18 through an EGR valve 28. The EGR valve 28 comprises a valve housing 30, a diaphragm 32 extending across the interior of the valve housing 30 to provide an exhaust gas chamber 34 and a vacuum chamber 36. The vacuum chamber 36 is connected through a vacuum level control valve 38 to the second port 40 of the intake passage 12 provided downstream of the throttle valve 18. The vacuum level control valve 38 is responsive to a control signal from an electronic control circuit 90 for introducing a controlled degree of vacuum from the suction vacuum developed in passage 12 into the EGR valve vacuum chamber 36 to control the opening of the EGR valve 28 so that EGR flow can be controlled in accordance with intake air flow or engine suction vacuum appearing in the intake passage 12 downstream of the throttle valve 18. An orifice 42 is provided in the EGR passage 24 downstream of the EGR valve 28, i.e., between the EGR valve 28 and the first port 26.

In order to detect suction vacuum appearing in the intake passage 12 downstream of the throttle valve 18, a suction vacuum sensor 44 is provided which comprises a sensor housing 46, a partition 48 formed centrally with a through-hole 50 and extending across the interior of the sensor housing 46 to form first and second pressure chambers 52 and 54, and a semiconductor pressure sensitive element 56, which may be taken in the form of a Si strain gauge, mounted on the partition 48 within the second pressure chamber 54 to close the through-hole 50. The first pressure chamber 52 is connected through a vacuum introduction tube 58 to the third port 60 of the intake passage provided downstream of the throttle valve 18 and the second pressure chamber 54 is evacuated so that the pressure sensitive element 56 can detect the absolute value of the engine suction vacuum.

In order to detect the difference between engine suction vacuum and EGR passage pressure, i.e., the pressure difference between the opposite sides of the orifice 42, a pressure difference sensor 62 is provided which comprises a sensor housing 64, a partition 66 formed centrally with a through-hole 68 and extending across the sensor housing 64 to provide first and second pressure chambers 70 and 72, and a semi-conductor pressure sensitive element 74, which may be taken in the form of a Si strain gauge, mounted on the partition 66 within the second pressure chamber 72 to close the through-hole 68. The first pressure chamber 70 is connected through the vacuum introduction tube 58 to the third port 60 and the second pressure chamber 72 is connected through an EGR pressure introduction tube 76 to the EGR passage 24 downstream of the EGR valve 28 so that the pressure sensitive element 74 can detect the pressure difference between the opposite sides of the orifice 42 provided in the EGR passage 24. Since the EGR pressure introduction tube 76 is connected at its one end to the closed second pressure chamber 72, no recirculated exhaust gas enters in the second pressure chamber 72. This permits the use of a semiconductor pressure sensitive element without any temperature sealing means.

Figure 2:
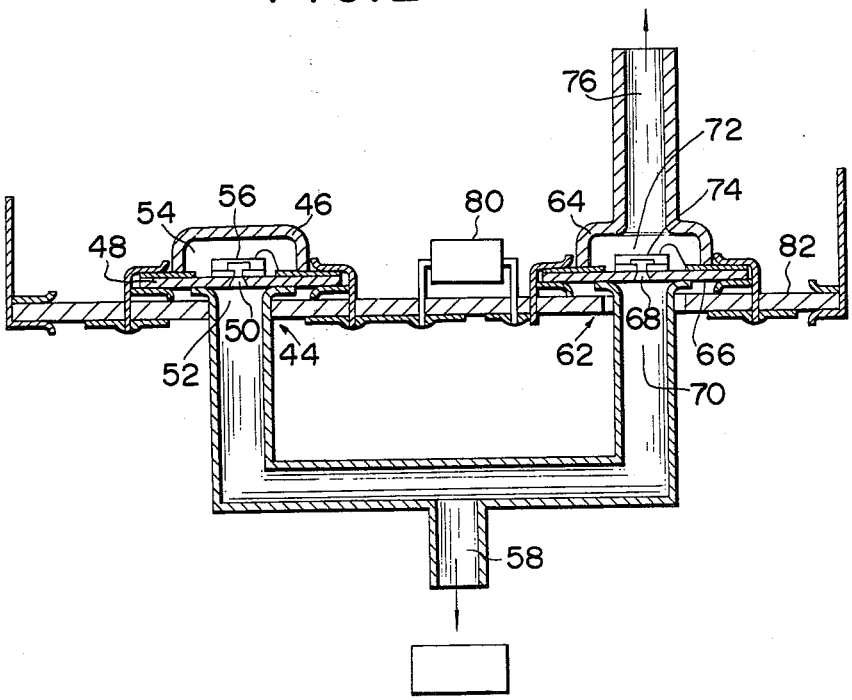
FIG. 2 is an enlarged sectional view showing the pressure sensors incorporated in the fuel supply control system of FIG. 1.

It can be seen from the foregoing that the pressure difference sensor 62 is substantially similar in structure to the vacuum sensor 44 except that the second pressure chamber 72 is connected to the EGR passage 24. Thus, the same testing device can be used for inspection of the sensors 44 and 62. The reference numeral 80 designates amplifiers, only one of which is illustrated, for amplifying the outputs of the respective sensors 44 and 62. From the standpoints of size-reduction and easy-installation, it is preferable to attach, as a unit, the sensors 44 and 62 and the amplifiers 80 on the same base plate 82 as shown in FIG. 2

The outputs of the sensors 44 and 62, the throttle opening sensor 20, and a speed sensor 85 are connected to the inputs of an electronic control circuit 90 having its outputs coupled to the fuel injection valve 22 and the vacuum level control valve 38 for controlling their operations.

In operation, if there is no EGR flow, the pressure difference sensor 62 detects no pressure difference between the opposite sides of the orifice 42. Under this condition, the amount of fuel supplied to the engine is determined in accordance with the intake air flow derived from the engine suction vacuum detected by the suction pressure sensor 44 and the engine speed detected by the speed sensor.

If there is any EGR flow, the pressure difference sensor 62 detects a pressure difference between the opposite sides of the orifice 42. Under this condition, the amount of fuel supplied to the engine is determined in accordance with the intake air flow derived from the engine suction vacuum detected by the suction pressure sensor 44 and the engine speed detected by the speed sensor 85 and corrected in accordance with the actual EGR flow rate which is calculated from the pressure differential across the orifice 42, as sensed by the pressure difference sensor 62. The electronic control circuit 90 has EGR flow rate values stored therein as optimum values for engine operating conditions.

The actual EGR rate can be obtained from the derived intake air flow and EGR flow. If there is any difference between the calculated EGR flow rate value and the programmed value the electronic control circuit provides a control signal to the vacuum level control valve 38 which thereby controls the vacuum in the EGR valve vacuum chamber 36 to adjust the EGR flow rate to the programmed value such that a pressure difference corresponding to the desired EGR rate appears at the opposite sides of the orifice 42.

The intake air flow and EGR flow may be calculated on the basis of data previously memoried in the electronic control circuit or may be read from a data table. The latter permits simplification of the electronic control circuit.

In the above described embodiment of the present invention, inexpensive and accurate semiconductor pressure sensitive sensors are used to detect pressures from which intake air flow can be derived. This eliminates the need for any expensive intake air flow sensor and permits accurate control of the amount of fuel supplied to the engine.

What is claimed is:

1. A fuel supply control system for use in an internal combustion engine including an intake passage provided therein with a throttle valve, an exhaust passage, and an exhaust gas recirculation passage connecting said exhaust passage to a first port of said intake passage provided downstream of said throttle valve and containing an exhaust gas recirculation valve, comprising:

(a) a suction vacuum sensor for detecting the engine suction vacuum appearing in said intake passage downstream of said throttle valve, (b) an orifice provided in said exhaust gas recirculation passage between said first port and said exhaust gas recirculation valve, (c) a pressure difference sensor for detecting the pressure difference between the opposite sides of said orifice, (d) a speed sensor for detecting the speed of rotation of said engine, and (e) means for determining an amount of fuel supplied to said engine in accordance with the intake air flow derived from the engine suction vacuum detected by said suction vacuum sensor and the engine speed detected by said speed sensor and corrected in accordance with the exhaust gas recirculation flow derived by the pressure difference detected by said pressure difference sensor.

2. A fuel supply control system according to claim 1, wherein said suction vacuum sensor comprises a sensor housing, a partition formed centrally with a through-hole and extending across the interior of said sensor housing to form first and second pressure chambers a semiconductor pressure sensitive element mounted on said partition within said second pressure chamber 54 to close said through-hole, said first pressure chamber connected to a second port of said intake passage provided downstream of said throttle valve, and said second pressure chamber being evacuated vacuum so that said semiconductor pressure sensitive element detects the absolute value on the engine suction vacuum appearing in said intake passage downstream of said throttle valve.

3. A fuel supply control system according to claim 2, wherein said semiconductor pressure sensitive element is in the form of a Si strain gauge.

4. A fuel supply control system according to claim 1, wherein said pressure difference sensor comprises a sensor housing, a partition formed centrally with a through-hole and extending across the interior of said sensor housing to provide first and second pressure chambers, a semiconductor pressure sensitive element mounted on said partition within said second chamber to close said through-hole, said first pressure chamber connected to a second port of said intake passage provided downstream of said throttle valve, and said second pressure chamber connected to said exhaust gas recirculation passage downstream of said exhaust gas recirculation valve so that said pressure sensitive element can detect the pressure difference between the opposite sides of said orifice.

5. A fuel supply control system according to claim 4, wherein said semiconductor pressure sensitive element is in the form of a Si strain gauge.

6. A fuel supply control system according to claim 1, which further comprises a vacuum level control valve for controlling the vacuum level of the vacuum chamber of said exhaust gas recirculation valve such that a pressure difference corresponding to the exhaust gas recirculation rate appears at the opposite sides of said orifice.

* * * * *